US005289710A

United States Patent [19]

Lau

[11] Patent Number: 5,289,710

[45] Date of Patent: Mar. 1, 1994

[54] APPARATUS FOR BENDING A FLEXIBLE CONDUIT

[75] Inventor: James Chung-Kei Lau, Torrance, Calif.

[73] Assignee: TRW Inc., Redondo Beach, Calif.

[21] Appl. No.: 929,254

[22] Filed: Aug. 12, 1992

[51] Int. Cl.[5] ..... B21D 7/00; H01P 1/02; H01P 11/00

[52] U.S. Cl. ..... 72/298; 29/600; 333/249

[58] Field of Search ..... 72/298, 295, 301; 29/600; 333/249, 248, 241

[56] References Cited

U.S. PATENT DOCUMENTS 2,914,741 11/1959 Unger ..... 333/249
2,920,676 1/1960 Turnblade ..... 72/298
3,553,990 1/1971 Suding ..... 72/298

FOREIGN PATENT DOCUMENTS 449037 6/1948 Canada ..... 333/248
646244 8/1962 Canada ..... 72/298

*Primary Examiner*—Daniel C. Crane
*Attorney, Agent, or Firm*—Ronald L. Taylor

[57] ABSTRACT

An apparatus for the bending of a flexible conduit having first and second ends includes first and second assemblies which are fixed for relative rotation with the first and second ends. An axis of rotation passes through the first and second assemblies. The apparatus further includes a driven gear fixed for rotation with the first assembly. The driven gear is adapted to cooperate with a drive gear to rotate the first assembly with respect to the second assembly. The first assembly includes a first extendable portion which attaches directly to the first end. Similarly, the second assembly includes a second extendable portion which attaches directly to the second end. The first and second assemblies function to vary the distance between the axis of rotation and the first and second ends as the first assembly is rotated with respect to the second assembly.

18 Claims, 3 Drawing Sheets

APPARATUS FOR BENDING A FLEXIBLE CONDUIT

BACKGROUND OF THE INVENTION

1. Field of the Invention

The present invention relates, in general, to the transmission of fluids or electromagnetic waves. More particularly, the present invention relates to an apparatus for the smooth bending of a flexible conduit, such as a waveguide.

2. Discussion of the Related Art

It is well known that the propagation of electromagnetic waves can be guided through the application of conducting or metallic boundaries. If the frequency of an electromagnetic wave is high enough that the wavelength is comparable to the cross-sectional dimensions of the boundaries, then transmission between the boundaries becomes well defined. With uniform (non-tapered) boundaries, the voltage or current applied at the sending end of the boundaries determines the shape of the initial voltage or current wave. With boundaries having negligible losses, the transmitted shape remains unchanged.

Various devices have been employed in order to constrain or guide the propagation of electromagnetic waves along a path defined by the physical construction of the device. These devices include coaxial transmission lines and strip lines. Coaxial transmission lines consist of a dielectric material bounded by two coaxial, cylindrical conducting walls. Strip lines are constructed with a metal strip above a metal plane or with a metal strip between two metal planes. In either case, a dielectric material is used to insulate the metal strip and the ground plane or planes.

It is also known that the propagation of electromagnetic waves can be guided by using a waveguide. In a broad sense, devices such as coaxial transmission lines can be categorized as waveguides. However, in a more restricted sense and that used herein, the term waveguide refers to a metallic tube adapted to confine and guide the propagation of electromagnetic waves in the hollow space along the longitudinal direction of the tube. Hollow waveguides of convenient sizes are readily adapted to the transmission of microwaves.

While prior devices for guiding the transmission of electromagnetic waves have generally proven effective, they also have been associated with several disadvantages. For example, flexible waveguides are often used in microwave systems where rotation of part of the system with respect to the remainder of the system is required. An example of a system in which rotation would be desirable is a transmitter wherein it is necessary to guide electromagnetic waves between the transmitter and a rotatable antenna.

Simple rotation of one end of a flexible waveguide with respect to the other end using a fixed axis of rotation causes the effective length of the waveguide to become compressed. This compression often causes the waveguide to buckle. When buckling occurs, the stresses and strains involved can be expected to be higher than that encountered in simple bending. Such higher stresses and strains often lead to premature failure where the flexible waveguide is subject to repeated cycling.

Furthermore, buckling tends to change the effective length of the waveguide and often leads to undesired phase shifting of the transmitted electromagnetic waves. The greater the angle of rotation, the greater change in the effective length of the waveguide.

Thus, it is highly desirable to provide an apparatus which minimizes buckling of a flexible waveguide throughout rotation. That is, it is highly desirable to provide an apparatus for smooth bending of a flexible waveguide. Simple, uniform bending of a flexible waveguide provides a uniform level of stress and strain, at an optimal, minimized level. Further, as many flexible waveguides are designed to be cycled repeatedly during operation, reduced stress and strain levels can be expected to significantly increase component life and thereby decrease maintenance and replacement.

SUMMARY OF THE INVENTION

In order to overcome the shortcomings associated with the prior art, the present invention provides an apparatus for the bending of a flexible conduit. The apparatus comprises a flexible conduit having a longitudinal axis extending therethrough. The flexible conduit includes receiving and transmitting ends. The apparatus further comprises first and second assemblies which are fixed for relative rotation with the transmitting and receiving ends, respectively. The first and second assemblies include first and second extendable members, respectively, adapted to attach to the receiving and transmitting ends of the conduit. The distances between a common axis of rotation and the ends of the conduit vary as the first assembly is rotated with respect to the second assembly.

In the preferred embodiment, the apparatus further includes a driven gear fixed for rotation with one of the first and second assemblies. The driven gear is adapted to cooperate with a drive gear to rotate one of the assemblies with respect to the other assembly.

Additional advantages and features of the present invention will become apparent to those skilled in the art from the following description and appended claims, taken in conjunction with the accompanying drawings.

DETAILED DESCRIPTION OF THE PREFERRED EMBODIMENTS

Figure 1:
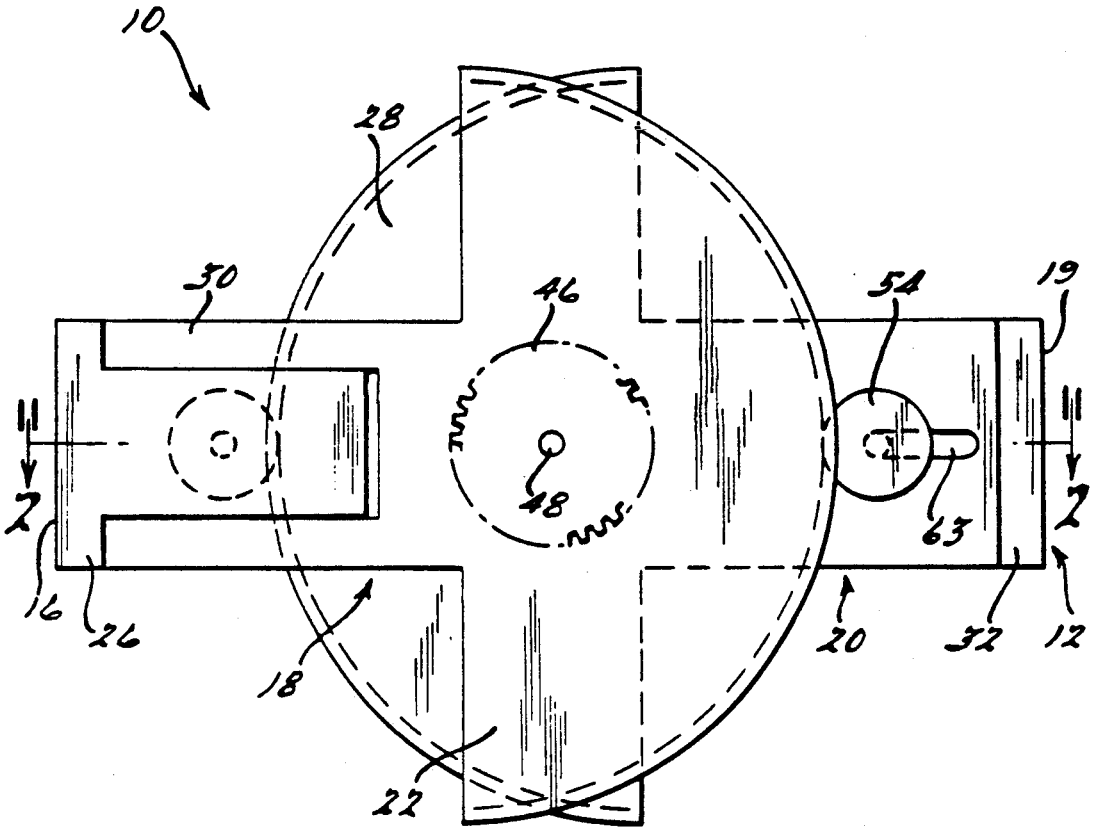
FIG. 1 is a right side view of an apparatus constructed in accordance with the teachings of the present invention.

While the present invention is applicable to a wide range of different applications, it will be described in the context of electromagnetic wave transmission. It will be appreciated by those skilled in the art, that the teachings of the present invention are equally applicable to applications including fluid transmission.

As generally shown in the figures, illustrated is a preferred embodiment of the apparatus 10 for the transmission of electromagnetic waves of the present invention. As illustrated, the waves are propagated right to left. The apparatus comprises a conduit, or flexible waveguide 12 having a longitudinal axis extending therethrough. The flexible conduit 12 includes a receiving end 14 and a transmitting end 16. The receiving end 14 of the flexible conduit 12 is adapted to be fixedly secured to the remainder of a microwave system (not shown).

If rotation of the flexible conduit 12 is achieved such that the center line length of the flexible conduit 12 remains unchanged throughout rotation, the flexible conduit 12 can be expected to take the shape of a portion of a uniform radius circle. Accordingly, the resultant radius of curvature is maximized and the stress and strain within the flexible conduit 12 are minimized.

The mathematical formulation of the problem is to maintain a constant center line length throughout rotation. The "distance" (D) from the instantaneous axis of rotation to the flexible, or transmitting end 16 is equal in magnitude to the distance from the instantaneous axis of rotation to the fixed or transmitting end 14. This distance can be described by the following equation:

$$D = \frac{L_o}{\theta} \tan \frac{\theta}{2};$$

where $\theta$ is the angle of rotation in radians and $L_o$ is the length of the flexible conduit 12.

The apparatus 10 of the present invention further comprises means for rotating the receiving and transmitting ends 14, 16 with respect to a single axis of rotation. In the preferred embodiment, this means for rotating comprises first and second assemblies 18, 20 adapted to be fixedly attached to transmitting and receiving ends 14, 16 of the flexible conduit 12. The first and second assemblies 18, 20 can be attached to the ends 14, 16 of the flexible conduit 12 in any of a number of suitable manners well known in the art, such as flanges 21 provided at the ends 14, 16 of the flexible conduit 12. As will become more apparent below, the first assembly 18 is further adapted to rotate relative to the second assembly 20.

The first assembly 18 includes a first cam portion 22 integrally including a first stem portion 24, and also including a first extendable member 26. The second assembly 20 is substantially identical to the first assembly 18 and similarly includes a second cam portion 28 integrally including a second stem portion 30, and also including a second extendable member 32. The first and second stem portions 24, 30 are formed to include first and second channels 34, 36, respectively, adapted to slidably receive the respective extendable member 26, 32.

The first extendable member 26 is substantially L-shaped and includes a first leg 38 which extends substantially perpendicular to the plane defined by the first stem portion 24, to which the transmitting end 16 of the flexible conduit 12 is attached. The first extendable member 26 further includes a second leg 40 having a portion 41 which is adapted to be received in the first channel 34, thereby facilitating slidable movement of the first extendable member 26 relative to the first stem portion 24. It will be appreciated by those skilled in the art that a suitable bearing (not shown) can be incorporated to further facilitate sliding movement of the first extendable member 26 relative to the first stem portion 24.

In the exemplary embodiment illustrated throughout the figures, the first assembly 18 is capable of rotating 90° both clockwise and counterclockwise with respect to the second assembly 20. In order to accommodate for this full range of rotation, it is necessary that $R_o$ be approximately equivalent to 0.3 $L_o$. However, $R_o$ can be adjusted for the necessary maximum rotation for a particular design. For example, $R_o$ can be made considerably smaller if a particular application only needs to be capable of rotation between 0° and 60°, clockwise or counterclockwise.

Similarly, the second extendable member 32 includes a first leg 42 which extends substantially perpendicular to the plane defined by the second stem portion 30 to which the receiving end 14 of the flexible conduit 12 is attached and a second leg 44 having a portion 45 adapted to be slidably received in the second channel 36.

The apparatus 10 of the present invention further comprises means for rotating the second assembly 20 with respect to the first assembly 18. In the preferred embodiment, the means for rotating the second assembly 20 with respect to the first assembly 18 is provided by a driven gear 46 fixedly attached to a pin 48. The pin 48 passes through and is splined to the second assembly 20 and rotatably passes through the first assembly 18. The driven gear 46 is adapted to be driven by a drive gear (not shown), such as a worm gear. Accordingly, when driven, the driven gear 46 causes the second assembly 20 to rotate relative to the first assembly 18, either clockwise or counterclockwise. The angle of rotation of the second assembly 20 with respect to the first assembly 18 varies directly proportionately to the number of turns of the driven gear 46.

Figure 2:
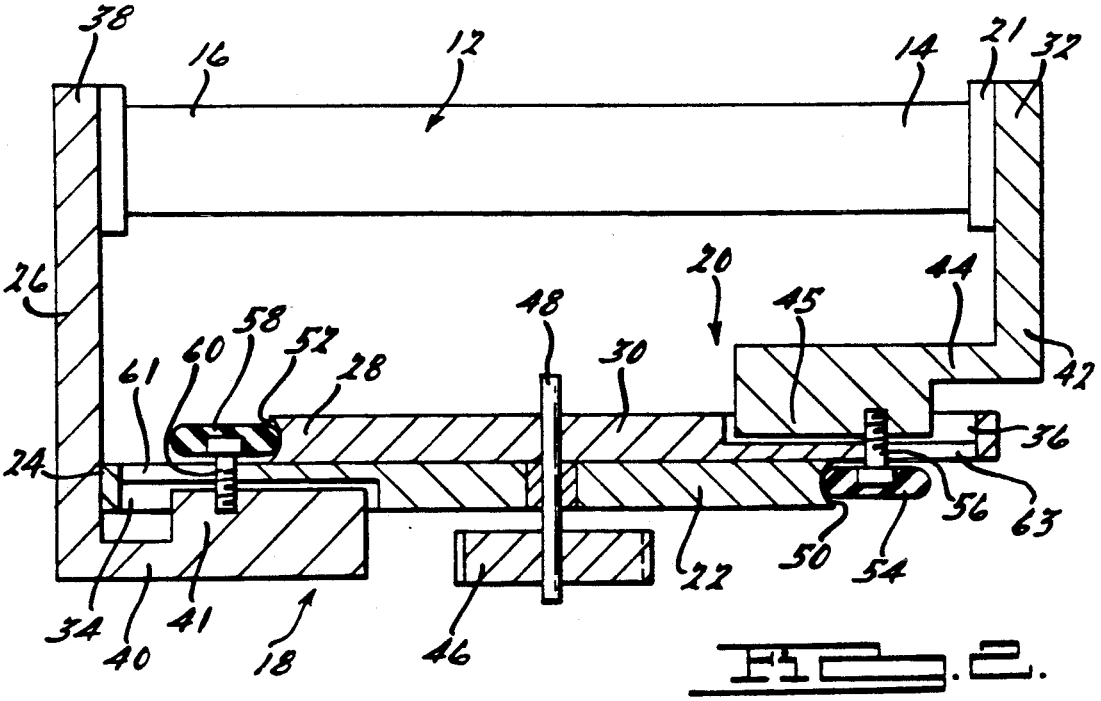
FIG. 2 is a cross-sectional view of the apparatus of FIG. 1 taken through the line 2—2 of FIG. 1, shown in operative association with a flexible conduit.
Figure 4:
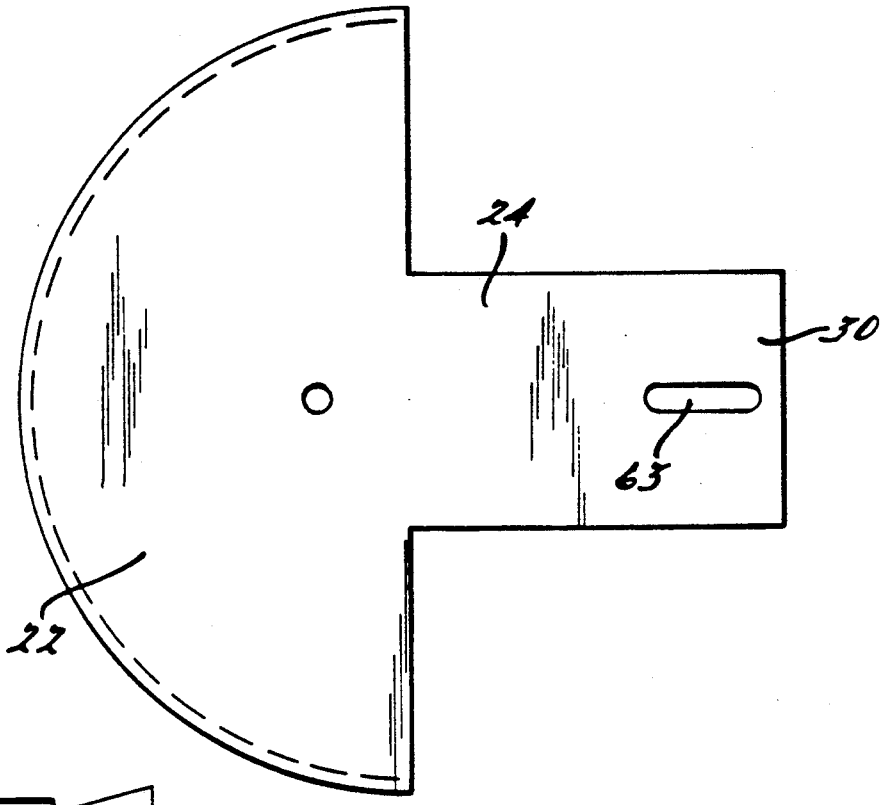
FIG. 4 is a left side view of the first cam portion of FIG. 3.
Figure 3:
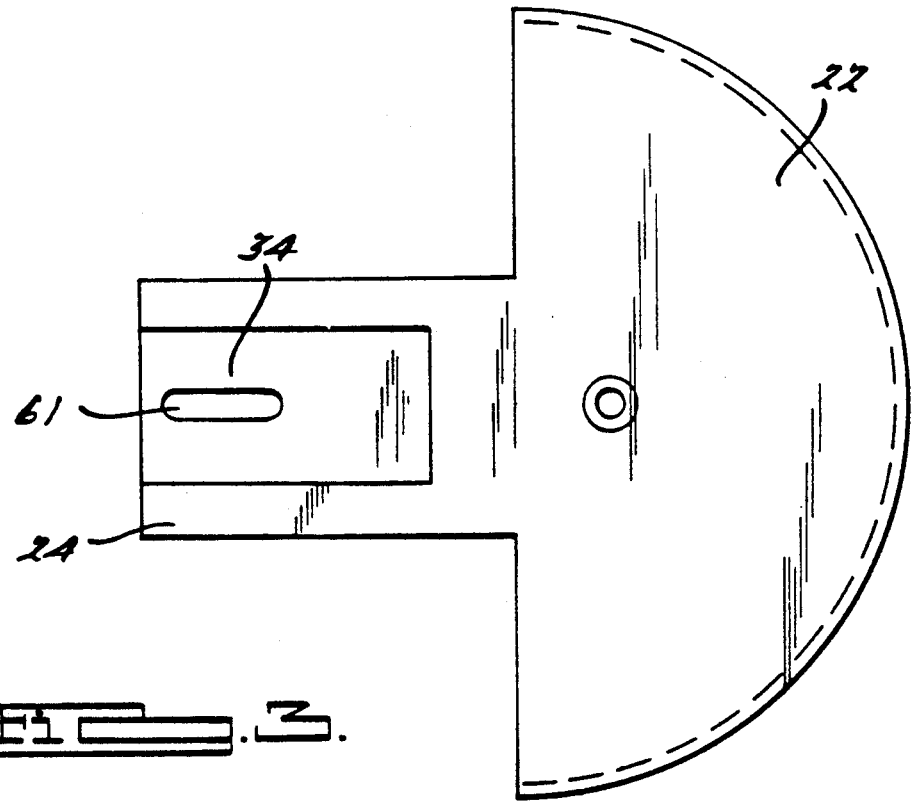
FIG. 3 is a right side view of the first cam portion of the present invention.

As shown in FIG. 2, the first and second cam portions 22, 28 of the first and second assemblies 18, 20 are formed so as to include first and second concave grooves 50, 52 which extend along the arcuate perimeters of the cam portions 22, 28, respectively. The first groove 50 serves to partially receive a rolling bearing 54 which is attached to the second stem portion 30 by a pin 56. Similarly, second groove 52 serves to partially receive a rolling bearing 58 attached to the first stem portion 24 by a pin 60. The first and second stem portions 24, 30 include first and second channels 61, 63, respectively. Pins 56, 60 are allowed to pass through channels 61, 63, respectively, as the extendable assemblies 26, 32 are extended. The significance of the cooperation between the rolling bearings 54, 58 and the first and second concave grooves 50, 52 will become more apparent below during the description of the operation of the apparatus.

The first and second cam portions 22, 28 are substantially identical and each includes an arcuate perimeter such that the following equation defines the distance between the instantaneous axis of rotation and the center of the rolling bearings 54, 58:

$$\text{“}R = Ro + \frac{Lo}{\theta} \tan \frac{\theta}{2} - \frac{Lo}{2}\text{”};$$

where $L_0$ is the length of the waveguide, $\theta$ is the angle of rotation expressed in radians and $R_o$ is an arbitrarily chosen (preferably small) length representing the horizontal distance between the axis of rotation and the arcuate perimeter at 0° of rotation.

As will be appreciated by those skilled in the art, particular applications involving the apparatus 10 of the present invention will require springs (not shown) to bias the first and second extendable members 26, 32 to their inboard positions. In this regard, it may be necessary to attach a spring (not shown) to the first extendable member 26 at one end, and to pin 48 at its other end. Likewise, the second extendable member 32 can be biased inwardly by attaching a spring to the second extendable member 32 and to the pin 48.

OPERATION OF THE APPARATUS OF THE PRESENT INVENTION

Figure 5:
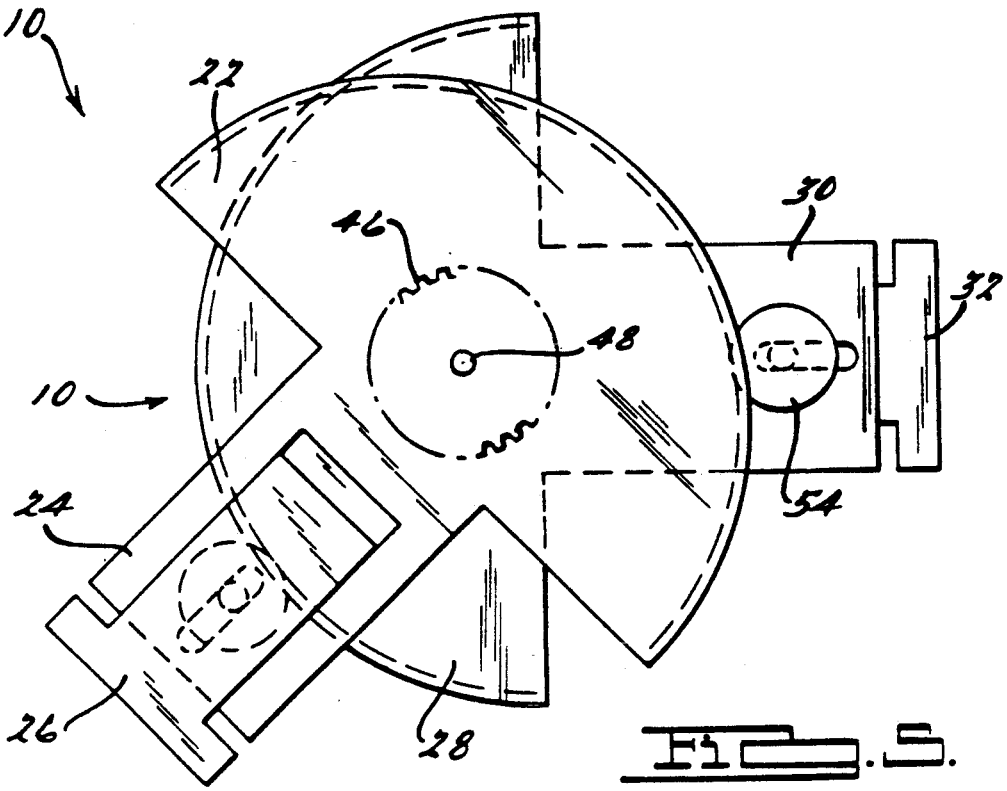
FIG. 5 is a right side view of the apparatus of FIG. 1 illustrating the first assembly rotated 45° relative to the second assembly.
Figure 6:
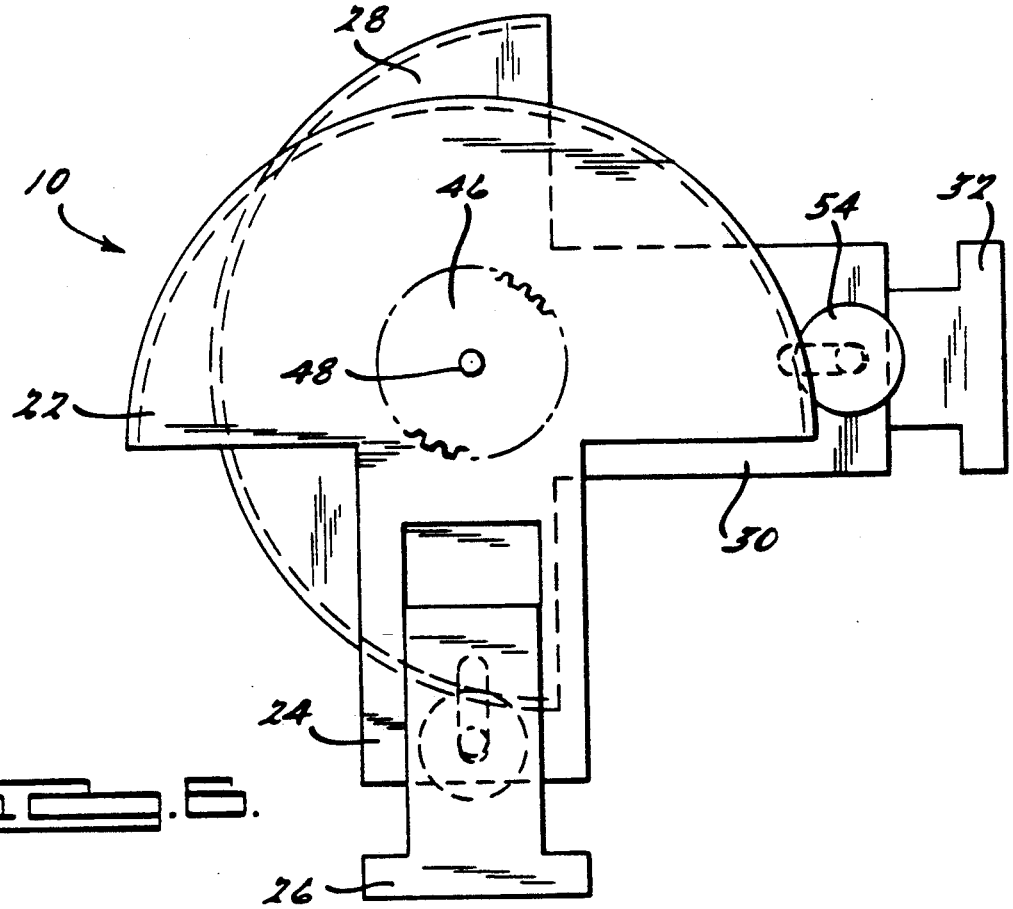
FIG. 6 is a right side view of the apparatus of FIG. 1 illustrating the first assembly rotated 90° relative to the second assembly.

With particular reference being made to FIGS. 1, 5 and 6, the operation of the apparatus 10 of the present invention will be described. Upon assembly of the apparatus 10, at 0° of rotation (FIG. 1), the first and second rolling bearings 54, 58 and the instantaneous axis of rotation, defined by pin 48, all lie within a single plane. As they are throughout rotation, the first and second rolling bearings 54, 58 partially extend into the first and second grooves 50, 52 respectively. Before rotation begins, the first and second extendable members 26, 32 are at their maximum inboard position.

As the driven gear 46 is turned by the drive gear (not shown) either clockwise or counterclockwise, the first assembly 18 is caused to correspondingly rotate with respect to the second assembly 20. FIGS. 5 and 6 illustrate 45° and 90° rotation of the first assembly 18 with respect to the second assembly 20, respectively. During rotation, the instantaneous axis of rotation defined by pin 48 is shifted horizontally. The distance between the instantaneous axis of rotation and the ends of the flexible conduit 14, 16 is altered to minimize stresses in the conduit 12. In this regard, the dimensioning of the perimeter of the first cam portion 22 causes the first rolling bearing 54 to extend the second extendable member 32. Simultaneously, the second cam portion 28 causes the second rolling bearing 58 to extend the first extendable member 26. Accordingly, the apparatus 10 uniformly bends the flexible conduit 12 to provide a minimized level of stress and strain.

The foregoing discussion merely describes an exemplary embodiment of the present invention. One skilled in the art will readily recognize from such discussion, and from the accompanying drawings and claims, that various changes, modifications and variations can be made therein without departing from the spirit and scope of the invention as defined in the following claims. For example, it will be readily appreciated that the first and second assemblies 18, 20 of the exemplary embodiment can be replaced with numerically controlled drive shafts. If numerically controlled drive shafts are incorporated, control software can be designed to obtain optimal length adjustments. Additionally, length may also be adjusted to minimize thermal, as well as other, stresses. It will also be readily appreciated that the teachings of the present invention are applicable to fluid handling systems incorporating a flexible conduit.

What is claimed is:

1. An apparatus for the controlled bending of a flexible conduit, said conduit having first and second ends, said apparatus comprising:

a first assembly adapted for attachment to said first end of said flexible conduit, said first assembly including a first cam surface and a first extendable portion;

a second assembly adapted for attachment to said second end of said flexible conduit, said second assembly being pivotally attached to said first assembly for rotation therewith about an axis of rotation passing through said first and second assemblies, said second assembly including a second extendable portion adapted to cooperate with said first cam surface of said first assembly; and a first, variable distance between said axis of rotation and said first end of said conduit;

whereby said first cam surface of said first assembly cooperates with said second extendable portion to vary said first distance as said second assembly is rotated with respect to said first assembly.

2. The apparatus of claim 1, wherein said second assembly includes a second cam surface adapted to cooperate with said first extendable portion and said apparatus further comprising:

a second, variable distance between said axis of rotation and said second end of said conduit;

whereby said second cam surface cooperates with said first extendable portion to vary said second distance as said second assembly is rotated with respect to said first assembly.

3. The apparatus of claim 1, further comprising means for rotating said first assembly with respect to said second assembly.

4. The apparatus of claim 3, wherein said means for rotating said first assembly with respect to said second assembly comprises a driven gear fixedly attached to a pin, said pin being colinear with said axis of rotation.

5. The apparatus of claim 1, wherein said first assembly further includes a first bearing attached to said second extendable portion, said first bearing adapted to cooperate with said first cam surface.

6. The apparatus of claim 5, wherein said first cam surface has a perimeter with a concave groove formed thereon, said concave groove adapted to partially receive said bearing.

7. The apparatus of claim 5, wherein said first assembly further includes a first stem portion having a channel adapted to slidably receive said first extendable portion.

8. The apparatus of claim 7, wherein said first cam surface is substantially identical to said second cam surface.

9. The apparatus of claim 8, wherein said first assembly further includes a second bearing attached to said first extendable portion, said second bearing adapted to cooperate with said second cam surface.

10. An apparatus for the transmission of electromagnetic waves, said apparatus comprising:

a flexible waveguide having a longitudinal axis extending therethrough, said waveguide having opposed receiving and transmitting ends;

a first assembly attached to said transmitting end;

a second assembly attached to said receiving end;

an axis of rotation passing through said first and second assemblies; and a first distance between said axis of rotation and said transmitting end, said first distance being adjustable.

11. The apparatus of claim 10 further comprising a second distance between said axis of rotation and said receiving end, said second distance being adjustable.

12. The apparatus of claim 11, further comprising:

means for rotating said first assembly with respect to said second assembly.

13. The apparatus of claim 10, wherein said means for rotating said first assembly with respect to said second assembly comprises a driven gear fixedly attached to a pin, said pin being colinear with said axis of rotation.

14. The apparatus of claim 12, further comprising means for adjusting said first distance.

15. The apparatus of claim 14, wherein said first assembly includes a first extendable member and further wherein said means for adjusting said first distance comprises a first rolling bearing attached to said second assembly, said first rolling bearing adapted to cooperate with said first assembly.

16. The apparatus of claim 14, further comprising means for adjusting said second distance.

17. The apparatus of claim 16, wherein said means for adjusting said second distance comprises a second rolling bearing attached to said first assembly, said second rolling bearing adapted to cooperate with said second assembly.

18. The apparatus of claim 15, wherein said second assembly includes a cam-like portion having a perimeter with a concave groove formed therein, said concave groove adapted to partially receive said first rolling bearing.

* * * * *